US009440775B2

(12) United States Patent
Dwyer et al.

(10) Patent No.: US 9,440,775 B2
(45) Date of Patent: Sep. 13, 2016

(54) PREFILTER COVER FOR BIDIRECTIONAL-AIRFLOW RESPIRATOR CARTRIDGE

(71) Applicant: 3M INNOVATIVE PROPERTIES COMPANY, St. Paul, MN (US)

(72) Inventors: Gary Edward Dwyer, Mallorytown (CA); Pierre Legare, Brockville (CA)

(73) Assignee: 3M Innovative Properties Company, St. Paul, MN (US)

( * ) Notice: Subject to any disclaimer, the term of this patent is extended or adjusted under 35 U.S.C. 154(b) by 336 days.

(21) Appl. No.: 14/285,197

(22) Filed: May 22, 2014

(65) Prior Publication Data

US 2015/0336718 A1 Nov. 26, 2015

(51) Int. Cl.

| | |
|---|---|
| ***B65D 43/16*** | (2006.01) |
| ***B65D 85/00*** | (2006.01) |
| ***A62B 18/02*** | (2006.01) |
| ***A62B 18/04*** | (2006.01) |
| ***A62B 23/02*** | (2006.01) |
| ***A62B 18/00*** | (2006.01) |
| ***A62B 25/00*** | (2006.01) |

(52) U.S. Cl.

CPC ..... *B65D 43/162* (2013.01); *A62B 18/006* (2013.01); *A62B 18/025* (2013.01); *A62B 23/02* (2013.01); *A62B 23/025* (2013.01); *A62B 25/00* (2013.01); *B65D 85/70* (2013.01)

(58) Field of Classification Search

CPC .... A62B 18/02; A62B 18/025; A62B 18/04; A62B 18/045; A62B 23/02; B65D 43/0204; B65D 43/0214; B65D 43/06; B65D 43/08; B65D 43/161; B65D 85/70

See application file for complete search history.

(56) References Cited

U.S. PATENT DOCUMENTS

| | | | | |
|---|---|---|---|---|
| 2,055,853 | A * | 9/1936 | Schwartz | A62B 23/00 128/206.17 |
| 2,895,472 | A | 7/1959 | Matheson | |
| 4,463,757 | A | 8/1984 | Schmidt | |
| 4,487,606 | A | 12/1984 | Leviton | |
| 4,832,018 | A | 5/1989 | Pantaleon-Stemberg | |
| 4,921,512 | A * | 5/1990 | Maryyanek | A62B 23/02 55/486 |
| 5,036,844 | A | 8/1991 | Pouchot | |
| 5,222,488 | A | 6/1993 | Forsgren | |
| 6,298,849 | B1 * | 10/2001 | Scholey | A62B 7/10 128/205.27 |
| 6,363,934 | B2 | 4/2002 | Metzger | |
| 6,761,169 | B2 | 7/2004 | Eswarappa | |
| 6,783,566 | B2 | 8/2004 | Estkowski | |
| 7,114,496 | B1 | 10/2006 | Resnick | |
| 7,255,627 | B2 | 8/2007 | Bodnar | |
| 7,559,323 | B2 | 7/2009 | Hacke | |
| 8,312,876 | B2 | 11/2012 | Mutze | |

(Continued)

FOREIGN PATENT DOCUMENTS

| | | |
|---|---|---|
| CN | 201135717 | 10/2008 |
| JP | 2013-124658 | 6/2013 |

(Continued)

OTHER PUBLICATIONS

International Search Report, PCT/US2015/029879, dated Jul. 24, 2015, 3 pages.

*Primary Examiner* — Lynne Anderson
*Assistant Examiner* — Kathryn E Ditmer
(74) *Attorney, Agent, or Firm* — Kenneth B. Wood

(57) ABSTRACT

A prefilter cover for a bidirectional-airflow respirator cartridge, the prefilter cover including front and rear clamshell portions that are flexibly connected by a flexible connecting member.

23 Claims, 4 Drawing Sheets

(56) References Cited

U.S. PATENT DOCUMENTS

| | | | | |
|---|---|---|---|---|
| 8,402,966 | B2 | 3/2013 | Morgan, III | |
| 8,460,423 | B2 | 6/2013 | Legare | |
| 8,590,532 | B2 | 11/2013 | Forbes | |
| 8,900,338 | B2 * | 12/2014 | Lawrence | A62B 18/08 128/201.25 |
| 2006/0283453 | A1 | 12/2006 | Haddad | |
| 2008/0156329 | A1 * | 7/2008 | Gerson | A62B 23/02 128/206.12 |
| 2009/0215618 | A1 * | 8/2009 | Fansler | C08K 5/17 502/402 |
| 2010/0132712 | A1 | 6/2010 | Mutze | |
| 2011/0036347 | A1 * | 2/2011 | Morgan, III | A62B 18/025 128/201.19 |
| 2013/0125896 | A1 | 5/2013 | Dwyer | |
| 2014/0041348 | A1 | 2/2014 | Lawrence | |
| 2014/0216475 | A1 | 8/2014 | Blomberg | |

FOREIGN PATENT DOCUMENTS

| | | |
|---|---|---|
| WO | WO 2008-082415 A1 | 7/2008 |
| WO | WO 2013-008226 A1 | 1/2013 |
| WO | WO 2014-015401 | 1/2014 |

* cited by examiner

PREFILTER COVER FOR BIDIRECTIONAL-AIRFLOW RESPIRATOR CARTRIDGE

BACKGROUND

Respirators are often used for treating air to be breathed by a user, and commonly include a respirator body along with one or more respirator cartridges that are attached to the respirator body.

SUMMARY

In broad summary, herein is disclosed a prefilter cover for a bidirectional-airflow respirator cartridge, the prefilter cover comprising front and rear clamshell portions that are flexibly connected by a flexible connecting member. These and other aspects will be apparent from the detailed description below. In no event, however, should this broad summary be construed to limit the claimable subject matter, whether such subject matter is presented in claims in the application as initially filed or in claims that are amended or otherwise presented in prosecution.

Figure 1:
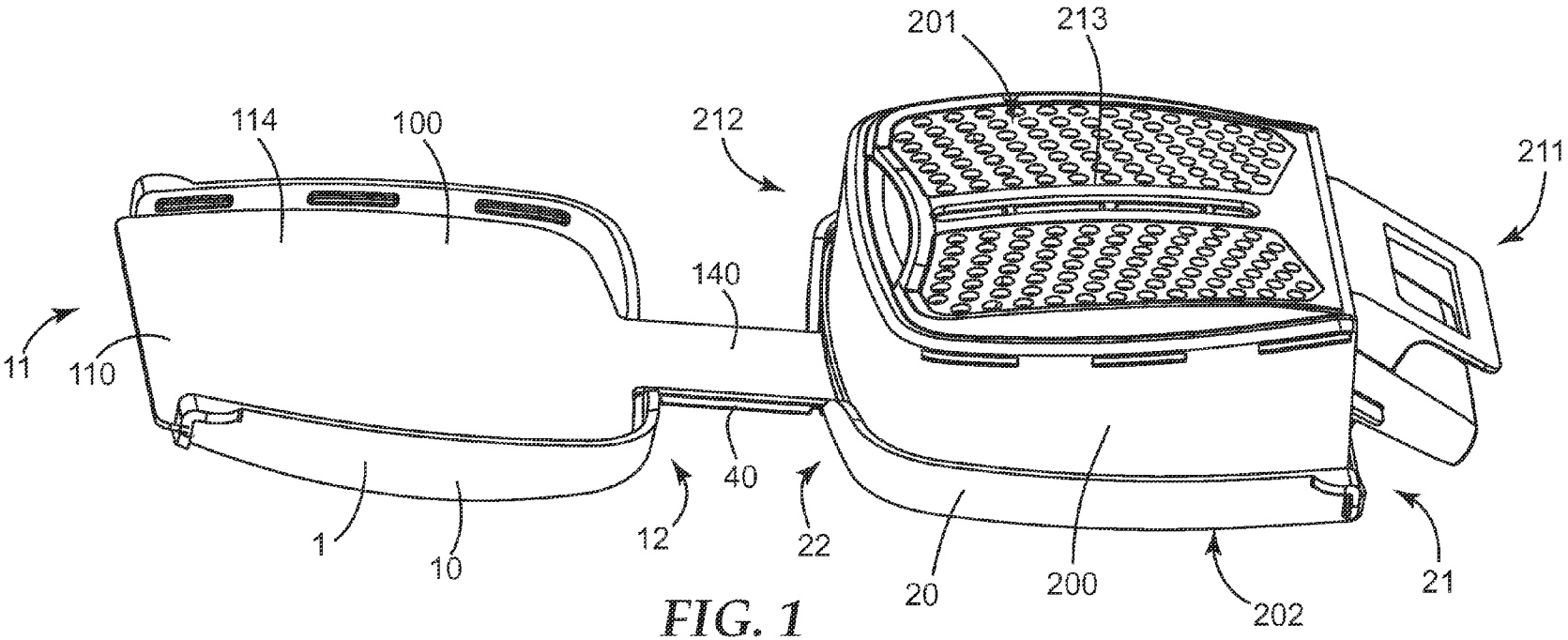
FIG. 1 is a perspective view of an exemplary prefilter and prefilter cover, partially mounted on a bidirectional-airflow respirator cartridge.

Like reference numbers in the various figures indicate like elements. Some elements may be present in identical or equivalent multiples; in such cases only one or more representative elements may be designated by a reference number but it will be understood that such reference numbers apply to all such identical elements. Unless otherwise indicated, all figures and drawings in this document are not to scale and are chosen for the purpose of illustrating different embodiments of the invention. In particular the dimensions of the various components are depicted in illustrative terms only, and no relationship between the dimensions of the various components should be inferred from the drawings, unless so indicated. Although terms such as "top", bottom", "upper", lower", "under", "over", "up" and "down", and "first" and "second" may be used in this disclosure, it should be understood that those terms are used in their relative sense only unless otherwise noted.

As used herein as a modifier to a property or attribute, the term "generally", unless otherwise specifically defined, means that the property or attribute would be readily recognizable by a person of ordinary skill but without requiring absolute precision or a perfect match (e.g., within +/−20% for quantifiable properties). The term "substantially", unless otherwise specifically defined, means to a high degree of approximation (e.g., within +/−10% for quantifiable properties) but again without requiring absolute precision or a perfect match. Terms such as same, equal, uniform, constant, strictly, and the like, are understood to be within the usual tolerances or measuring error applicable to the particular circumstance rather than requiring absolute precision or a perfect match.

Glossary

The term "prefilter" denotes a porous material, e.g. a fibrous material, that is configured to be positioned adjacently upstream of an air-permeable major area of a respirator cartridge and that is configured to capture or otherwise remove at least some airborne particles from an airstream passing through the prefilter and into the respirator cartridge.

The phrase "bidirectional-airflow respirator cartridge" denotes a respirator cartridge configured to accept airflow through at least two generally oppositely-facing major faces thereof.

The term "proximal", as applied e.g. to an item such as a prefilter, a prefilter cover, and a respirator cartridge, is defined with respect to the respirator in which the item is used, and denotes an end of an item that is closest to the respirator body when the item is in position on the respirator. The term "distal", as applied to such items, denotes an end of the item that is furthest from the respirator body.

The term "front" is also defined with respect to the respirator in which an item is used, and denotes a direction that away from the face of a user wearing the respirator. The term "rear" denotes a direction closest to the face of a user wearing the respirator.

Terms such as "inside", "inward", and the like, as applied e.g. to an item such as a prefilter, a prefilter cover, and a respirator cartridge, are defined with respect to a respirator cartridge, and denote a direction toward the interior of a respirator cartridge. Terms such as "outside", "outward", and the like, denote a direction away from the interior of a respirator cartridge.

By "air-permeable" is meant allowing airflow therethrough, which may be achieved by any conventional means, e.g. the providing of perforated through-holes and the like.

By "removable" and like terms is meant that an item can be removed from (separated from) another item by hand by a user, without destroying or unacceptably damaging either of the items.

By "integral" and like terms is meant comprised of the same material and having been made together in a single operation, e.g. a molding operation.

DETAILED DESCRIPTION

Figure 2:
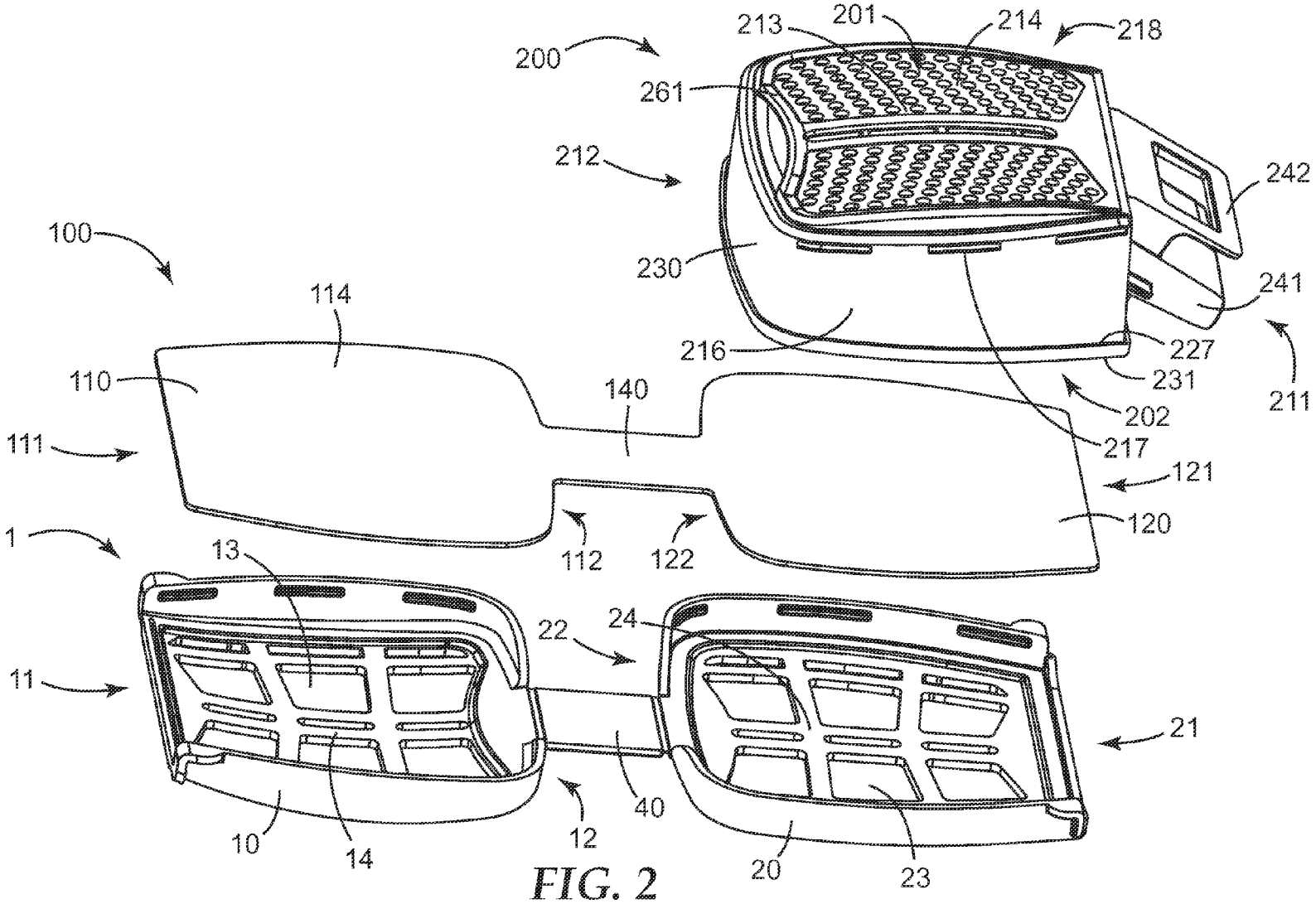
FIG. 2 is an exploded view of the prefilter cover, prefilter, and cartridge of FIG. 1.
Figure 3:
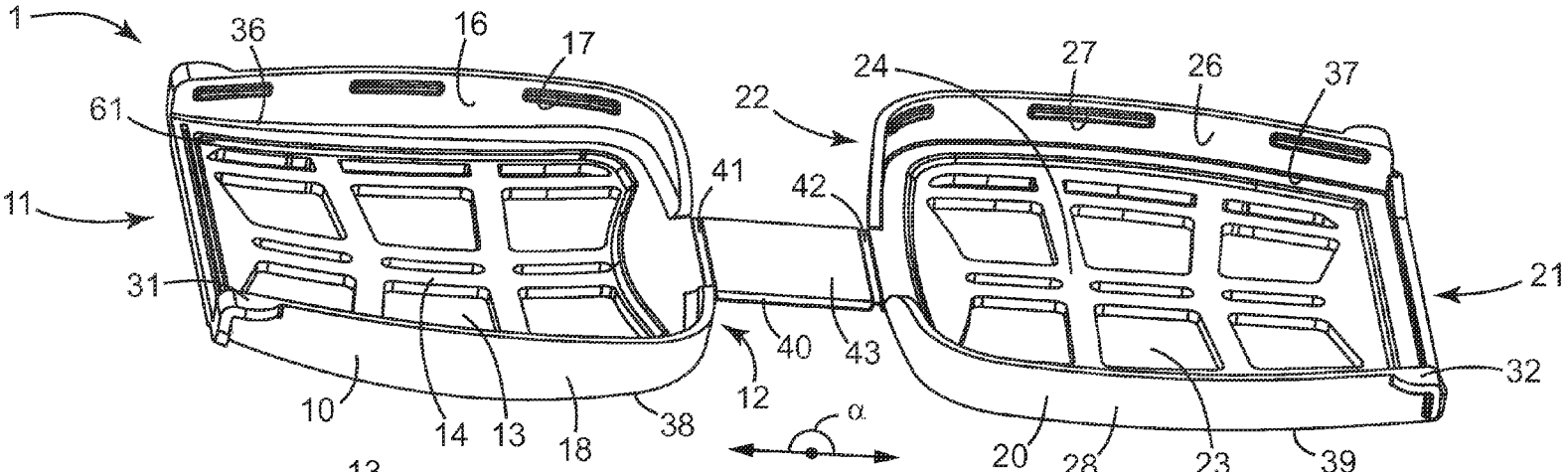
FIG. 3 is a magnified view of the prefilter cover of FIG. 2.

Shown in FIG. 1 is an exemplary prefilter cover 1 that is partially mounted on an exemplary bidirectional-airflow respirator cartridge 200. FIG. 2 presents an exploded view of the partial assembly of FIG. 1, and FIG. 3 presents a magnified view of prefilter cover 1. Prefilter cover 1 is of a clamshell design, comprising a front clamshell portion 10 with a proximal end 11 and a distal end 12 and an air-permeable major area 13, and further comprising a rear clamshell portion 20 with a proximal end 21 and a distal end 22 and an air-permeable major area 23. Prefilter cover 1 further comprises at least one flexible connecting member 40 that flexibly connects front clamshell portion 10 with rear clamshell portion 20. In particular embodiments, the at least one flexible connecting member 40 flexibly connects distal end 12 of front clamshell portion 10 with distal end 22 of rear clamshell portion 20, as seen e.g. in FIG. 3.

Prefilter cover 1 is adapted to be used with a bidirectional-airflow respirator cartridge, e.g. exemplary cartridge 200 as depicted herein. Exemplary cartridge 200 comprises proximal end 211 and distal end 212 and front face 201 and rear face 202, and is configured to accept airflow through air-permeable major area 213 of front face 201 of cartridge 200, as shown in FIGS. 1 and 2, as well as through a corresponding air-permeable major area (not visible from the vantage point of FIGS. 1 and 2) of rear face 202 of cartridge 200. Bidirectional-airflow cartridges of various types are described e.g. in U.S. Pat. No. 8,460,423 to Legare, in U.S. Patent Application Publication 2013/0125896 to Dwyer, in U.S. patent application Ser. No. 13/757,434, filed 1 Feb. 2013 and entitled Sleeve-Fit Respirator Cartridge, and in U.S. patent application Ser. No. 14/081,396, filed 15 Nov. 2013 and entitled Respirator with Floating Elastomeric Sleeve, the disclosures of all of which are incorporated by reference herein in their entirety.

It is often desirable to use a prefilter through which any airflow into a respirator cartridge must pass, in order that at least some particles be removed from the flowing airstream before the airstream enters the respirator cartridge. For a bidirectional-airflow cartridge, a prefilter may be used to perform such a function on a first (e.g., front) major face of the cartridge, and a prefilter may be likewise used on a second (e.g., rear) major face of the cartridge. Accordingly, prefilter cover 1 comprises front clamshell portion 10 that is adapted to be removably mounted on a front face 201 of a bidirectional-airflow respirator cartridge 200 and rear clamshell portion 20 that is adapted to be removably mounted on a rear face 202 of bidirectional-airflow respirator cartridge 200. (The terms "mounted" and "face" are used broadly and do not require, for example, that a front clamshell portion must be attached specifically to a frontmost surface of a front face.)

When front clamshell portion 10 is removably mounted on front face 201 of cartridge 200, front clamshell portion 10 holds a front prefilter 110 between air-permeable major area 13 of front clamshell portion 10 and air-permeable major area 213 of front face 201 of cartridge 200, so that front prefilter 110 is in occlusive, filtering relation to air-permeable major area 213 of cartridge 200. By occlusive, filtering relation is meant that the prefilter is positioned so that airflow can only pass through the air-permeable major area of the cartridge and into the interior of the cartridge, by way of passing through the prefilter. Similarly, when rear clamshell portion 20 is removably mounted on rear face 202 of cartridge 200, rear clamshell portion 20 holds a rear prefilter 120 between air-permeable major area 23 of rear clamshell portion 20 and an air-permeable major area (not visible in any Figure) of rear face 202 of cartridge 200, so that the rear prefilter is in occlusive, filtering relation to the air-permeable major area of the rear face of the cartridge.

In at least some embodiments, the above arrangements may hold front prefilter 110 sandwiched between inside surface 14 of air-permeable major area 13 of front clamshell portion 10 and outside surface 214 of air-permeable major area 213 of front face 201 of cartridge 200. Similar arrangements may hold rear prefilter 120 sandwiched between inside surface 24 of air-permeable major area 23 of rear clamshell portion 20 and an outside surface of the air-permeable major area of rear face 202 of cartridge 200. In particular embodiments, a clamshell portion (e.g., an inside surface thereof) may have one or more compressing structures that are configured to press (e.g., pinch) a particular area of the prefilter against an outside surface of the respirator cartridge. For example, front clamshell portion 10 may comprise at least one compressing structure 61 that presses a portion of inside surface 114 of front prefilter 110 against a receiving structure 261 of front face 201 of cartridge 200 (exemplary compressing structures 61 and receiving structures 261 are respectively depicted in FIGS. 3 and 2). In some embodiments, such a compressing structure 61 may at least partially bound (surround) air-permeable major area 13 of front clamshell portion 10; similarly, a receiving structure 261 may at least partially bound air-permeable major area 213 of front face 201 of cartridge 200. Such arrangements may serve e.g. to minimize any air leaks around the edge of an air-permeable major area.

The terms compressing structure and receiving structure are used broadly and encompass any suitable design. In some embodiments at least a portion of such a compressing structure may stand proud of (i.e., may protrude inward from, toward the interior of cartridge 200) surface 14 of air-permeable major area 13 of front clamshell portion 10. In other embodiments such a compressing structure may merely be a particular region of inside surface 14 of front clamshell portion 10, that does not necessarily protrude inward beyond other portions of surface 14. Similar considerations apply to receiving structure 261 in relation to outside surface 214 of air-permeable major area 213 of front face 201 of cartridge 200. Similar compressing structures and receiving structures, of any of the aforementioned types, may be respectively present on rear clamshell portion 20 and rear face 202 of cartridge 200.

In some embodiments prefilter 100 may be held in place between prefilter cover 1 and cartridge 200 purely by the pressure exerted by prefilter cover 1 as described below. However, in other embodiments, one or more ancillary mechanisms (e.g., latches, clasps, snaps, pincers, pins, and the like) may be used to enhance the holding of prefilter 100 in place. Similarly, any type of adhesive, mechanical fastener (e.g., hook and loop fastener) and the like may be used to such effect.

First and Second Positions of Clamshell Portions

To achieve the arrangements described above, front and rear clamshell portions 10 and 20 may be movable between at least a first position that is an "open" position that allows front and rear prefilters to be easily positioned in the respective front and rear clamshell portions of prefilter cover 1, and a second position that is a "closed" position that is attained when prefilter cover 1 (bearing the respective prefilters) is mounted on, e.g. attached to, cartridge 200. An exemplary first position is illustrated in FIGS. 1, 2 and 3; an exemplary second position is illustrated in FIGS. 4 and 5.

Figure 5:
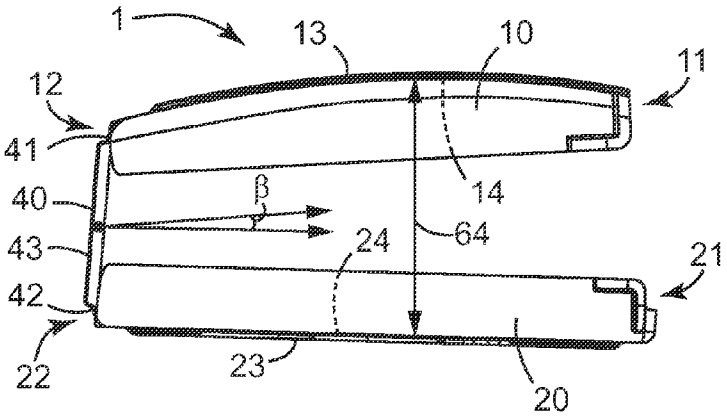
FIG. 5 is a side view of a prefilter cover fully mounted on a bidirectional-airflow respirator cartridge, with the respirator cartridge omitted.
Figure 4:
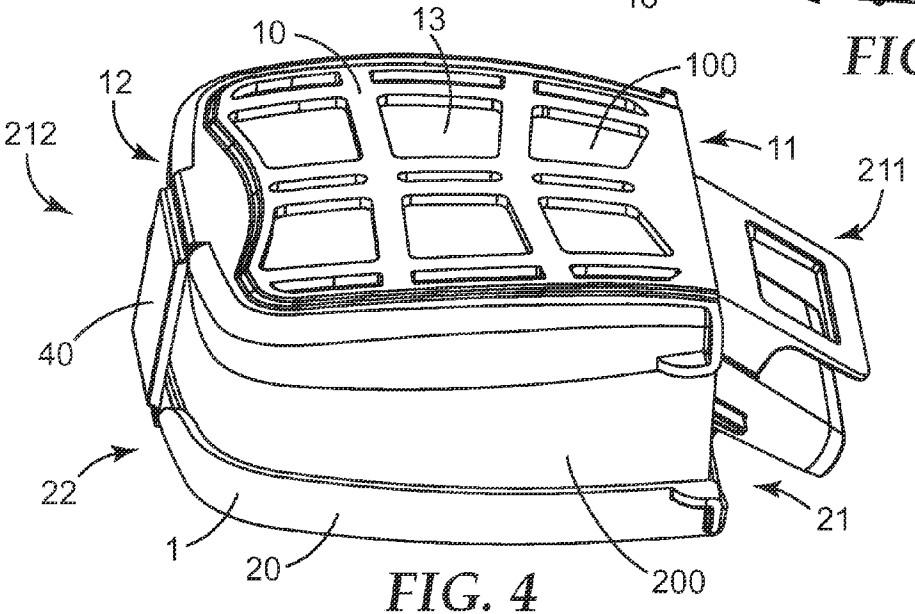
FIG. 4 is a perspective view of an exemplary prefilter cover fully mounted on a bidirectional-airflow respirator cartridge.

In further detail, front clamshell portion 10 and rear clamshell portion 20 may be movable relative to each other between at least a first position in which air-permeable major area 13 of front clamshell portion 10, and the air-permeable major area 23 of rear clamshell portion 20 are oriented at a first-position angle $\alpha$ relative to each other (as seen e.g. in FIG. 3); and, a second position in which air-permeable major area 13 of front clamshell portion 10 and air-permeable major area 23 of rear clamshell portion 20 are oriented at a second-position angle $\beta$ to each other (as seen e.g. in FIG. 5) and are in at least generally overlapping relation to each other (as evident in FIGS. 4 and 5). For purposes of these measurements, such angles are measured using a vertex that lies generally between distal end 12 of front clamshell portion 10 and distal end 22 of rear clamshell portion. In the exemplary embodiment of FIG. 3, the first-position angle $\alpha$ as defined above is in the range of about 180 degrees (in other words, the front and rear clamshell portions have been moved to the point that they extend in generally opposite directions). However, it will be appreciated that any suitable first-position angle α can be used, as long as it allows the front and rear prefilters to be easily positioned in the respective front and rear clamshell portions of prefilter cover 1. In various embodiments, such a first-position angle between front and rear clamshell portions may be at least about 45, 60, 75, 90, 120, 140, or 160 degrees.

An example of a prefilter cover in the second position is shown in FIG. 4, in perspective view with a cartridge 200 being present between the front and rear clamshell portions of the prefilter cover. An example of the second position is also shown in FIG. 5, in side view with cartridge 200 (and prefilter 100) omitted for clarity of presentation and with second-position angle β being identified. It will be appreciated that the second position is attained when prefilter cover 1 is fully mounted on cartridge 200. When front and rear clamshell portions 10 and 20 are in this second position, air-permeable major area 13 of front clamshell portion 10 and air-permeable major area 23 of rear clamshell portion 20 may often be in at least generally overlapping relation to each other.

As can most easily be seen in the side view of FIG. 5, in the exemplary embodiment of FIGS. 4 and 5 the second-position angle β as defined above is in the general range of about 5-15 degrees. In some embodiments, the second-position angle β may be near 0 degrees, that is, air-permeable major area 13 of front clamshell portion 10, and air-permeable major area 23 of rear clamshell portion 20, may be generally, substantially, or strictly parallel to each other (and in at least generally overlapping relation). However, as is evident from FIG. 5, it is not necessarily required that these major areas must be strictly parallel to each other. Thus, in various embodiments, when in the second position, second-position angle β may be less than about 35, 25, 20, 15, 10, or 5 degrees. In some embodiments the second-position angle β may be negative (e.g., in designs in which proximal ends 11 and 21 of front and rear portions 10 and 20 of cover 1 are closer to each other than distal ends 12 and 22 of front and rear portions 10 and 20 are to each other).

It will be evident from FIG. 5 that it is not required that either of major areas 13 or 23 must be strictly planar. It is emphasized that these areas are merely used as convenient references for describing the differences between the first, open position and the second, closed position. It will be understood that e.g. in the case in which one major air-permeable area is somewhat arcuate or domed (as may be the case with major area 13 in the design of FIG. 5), an average taken over the major area may be used as a reference "plane" for purposes of this characterization.

Offset Connection Between Clamshell Portions

Rather than being supplied e.g. as two separate prefilter covers, front clamshell portion 10 and rear clamshell portion 20 of prefilter cover 1 are connected by at least one flexible connecting member 40, which connects portions 10 and 20 and allows them to be moved between the first and second positions as described above. Flexible connecting member 40 may be configured to provide an offset connection between front and rear clamshell portions 10 and 20. Such an offset connection can provide that when portions 10 and 20 are in the second (closed) position, an offset distance is provided between portions 10 and 20 that allows a cartridge 200 of a particular front-rear dimension (thickness) to be fitted into the gap between clamshell cover portions 10 and 20.

For convenience of measurement, such an offset distance can be the distance 64 from inside surface 14 of air-permeable major area 13 of front clamshell portion 10, to inside surface 24 of air-permeable major area 23 of rear clamshell portion 20 (as exemplified in FIG. 5). In various embodiments, when prefilter cover 1 is in the second, closed position, offset distance 64 may be at least about 1, 2, 3, 4, 5, or 6 cm. (Again, the air-permeable major areas and inside surfaces thereof are used as convenient references; if one of the air-permeable major areas is arcuate rather than planar, and/or is at an angle versus the other major area when in the second, closed position, an average value may be used for purposes of this calculation.)

The design of flexible connecting member or members 40 may be chosen as desired. In the designs depicted herein, a single, sheet-like connecting member 40 is used. However, a plurality of rodlike members, filamentary connecting members (whether parallel to each other or random in orientation), and so on, may be used. Furthermore, the desired flexibility may be achieved in any suitable manner. For example, connecting member or members 40 may be inherently flexible, meaning that their combination of physical properties (e.g., bending modulus) and dimensions render them sufficiently flexible, along their entire length (from front clamshell portion 10 to rear clamshell portion 20) for use as described herein. Thus in some embodiments, a connecting member 40 may be used that is comprised of a resiliently flexible, e.g. elastomeric, material such as molded rubber. In other embodiments, one or more specific geometric features may be provided so that, whether or not connecting member 40 is inherently flexible along its entire length, it is nevertheless able to perform as desired.

In one example of this approach, flexible connecting member 40 may comprise a first living hinge 41 proximate front clamshell portion 10 and a second living hinge 42 proximate rear clamshell portion 20 (as most easily seen in FIGS. 3 and 5). The concept of a living hinge is well known to the ordinary artisan and can be achieved e.g. by providing the living hinge in the form of a locally thinned area that extends across a width of flexible connecting member 40. In various embodiments, such a locally thinned area may comprise a thickness that is less than about 0.5, 0.4, or 0.3 mm. In further embodiments, such a locally thinned area may comprise a thickness that is at least about 0.05, 0.1, 0.15, or 0.2 mm. In some embodiments, such a locally thinned area may exhibit a thickness that is appreciably less than the thickness of at least one area of the flexible connecting member that adjacently neighbors the thinned area along the length direction of the flexible connecting member. Such neighboring areas may, in various exemplary embodiments, comprise a thickness of at least about 0.7, 1.0, 2.0, 3.0, or 4.0 mm. Thus, in various embodiments, such a locally thinned area may exhibit a thickness that is less than about 70, 60, 50, 40, 30, 20, or 10% of the thickness of at least one area of the flexible connecting member that adjacently neighbors the thinned area along the length direction of the flexible connecting member. Often, such a thinned area may be bracketed between two such adjacently-neighboring areas that are appreciably thicker than the thinned area.

If e.g. two (or more) living hinges are used, it may not be necessary that a flexible connecting member 40 be inherently flexible along its entire length. Rather, as depicted in the arrangement of FIGS. 3 and 5, a major portion 43 of connecting member 40, between two such living hinges 41 and 42, may be relatively inflexible and/or may have a length that is chosen to achieve the above-discussed offset distance when prefilter cover 1 is placed into the second (closed) position. Thus in various embodiments, first and second living hinges in flexible connecting member 40 may be separated from each other, along the length of the flexible connecting member, by at least about 1, 2, 3, 4, 5, or 6 cm.

In some embodiments, a flexible connecting member 40 may be made of a different material than that of front clamshell portion 10 and/or rear clamshell portion 20. If so, such a flexible connecting member 40 may be joined to the front and rear clamshell portions in any convenient manner. In other embodiments, front clamshell portion 10, rear clamshell portion 20, and the at least one flexible connecting member 40 may all be all integral portions of a single integral molded piece. For example, all such portions may be made of a resilient, elastomeric rubber compound as noted above. However, in embodiments in which one or more living hinges are present, all such portions may be made of any suitable material (e.g., a molded thermoplastic material) that is known to serve well as a living hinge. Polyolefinic molding materials such as e.g. polypropylene and blends and copolymers thereof, in particular, are known to exhibit physical properties (e.g., fatigue resistance) commensurate with use in living hinge applications. However, any suitable material can be used as desired.

Prefilter

Turning to prefilter 100, this component, specifically front and rear portions 110 and 120 thereof, can be provided in any suitable manner. As mentioned, in some embodiments front and rear portions 110 and 120 can be physically separate pieces that are separately positioned in their front and rear respective clamshell cover portions in order to be fitted onto front and rear faces of a bidirectional-airflow respirator cartridge 200. However, in some embodiments, front prefilter portion 110 and rear prefilter 120 may be flexibly connected by a prefilter connecting portion 140 that extends between a distal end 112 of front prefilter 110 and a distal end 122 of rear prefilter 120, as depicted in FIGS. 1 and 2. In particular embodiments of this type, front prefilter portion 110, rear prefilter portion 120, and prefilter connecting portion 140 may all be portions of a single unitary, integral prefilter, in which the prefilter connecting portion 140 integrally extends between distal end 112 of front prefilter portion 110 and distal end 122 of rear prefilter portion 120. (It will be understood that in such embodiments, prefilter connecting portion 140, although made of filter material, will not necessarily perform any particle-filtering function.) In such embodiments, the single unitary integral prefilter can be provided, e.g. by die-cutting from a sheet of filter material, in the desired shape, e.g. so that front prefilter portion 110 comprises proximal end 111 and distal end 112, and so that rear prefilter portion 120 similarly comprises proximal end 121 and distal end 122. In further embodiments of this type, front prefilter portion 110 and rear prefilter portion 120 may be sized and shaped at least generally similar to each other so that so that the single unitary prefilter is front-rear reversible. By this is mean that, e.g. with reference to FIG. 2, the portion labeled 110 (the "front" prefilter portion), can fit properly in the "rear" clamshell portion 20 of the prefilter cover; similarly, the portion of prefilter 100 labeled 120 (the "rear" prefilter portion), can fit properly in the "front" clamshell portion 10 of the prefilter cover.

Any suitable material, e.g. with pore sizes selected as desired, may serve as prefilter 100, as long as it can provide the desired ability to filter particles (which term broadly encompasses e.g. solid particles, liquid droplets, aerosols, and so on). Such materials may be e.g. fabric materials (whether woven or nonwoven), reticulated materials, porous materials, membranes, screens, meshes, and so on. Nonwoven webs of e.g. melt-blown fibers or melt-spun fibers may be useful, especially when in a persistent electrically charged (electret) form. Electrically charged fibrillated-film fibers as also may be suitable, as well as rosin-wool fibrous webs and webs of glass fibers or solution-blown, or electrostatically sprayed fibers. Electric charge can be imparted to some fibers by contacting the fibers with water, by corona charging, by tribocharging, and so on. Additives can be included in the fibers to enhance the filtration performance of webs produced e.g. through a hydro-charging process. Fluorine atoms, in particular, can be disposed at the surface of the fibers in the filter layer to improve filtration performance in an oily mist environment.

Regardless of its composition, prefilter 100 may be conveniently provided as a sheet-like material, positioned so that the airstream must pass through the shortest dimension of the sheet-like material to reach an air-permeable major face of cartridge 200. In some embodiments, prefilter 100 may comprise multiple layers of filter material. For example, it may be desired to provide an upstream layer that filters larger particles, backed by one or more downstream layers that filter smaller particles. (Such filtering may also be achieved e.g. with a prefilter that is single-layer but is asymmetric, e.g. a so-called depth filter.) Thus in some cases at least one of an outside surface and an inside surface of a prefilter 100 may exhibit an indicia identifying a preferred outside-inside orientation of the prefilter.

As mentioned, front clamshell portion 10 may be removably mounted on a front face of a bidirectional-airflow respirator cartridge, and rear clamshell portion 20 may be removably mounted on a rear face of the respirator cartridge, to hold prefilter 100 in place as discussed above. Any suitable method of removable mounting may be used, and may rely on any suitable mode of attachment. Such attachment may rely e.g. on one or more fasteners, such as e.g. clips, bands, latches, and the like. Such fasteners may be provided along with (e.g., attached to) prefilter cover 1, or cartridge 200. Or, such fasteners may be provided separately to be attached by the user. Often, such fasteners may be provided in complementary pairs, one fastener residing on a clamshell portion and another fastener residing on the cartridge.

In some embodiments, the front and rear clamshell portions may be configured to fasten to each other (e.g. by way of elongated latches) rather than to cartridge 200. Such clamshell portions may thus be held in place on the cartridge (in other words, may be removably mounted on the cartridge) without one or both clamshell portions necessarily being fastened to the cartridge by any specific fastener. Rather, it is emphasized that the concept of a front clamshell portion being removably mounted on a front face of a bidirectional-airflow respirator cartridge and a rear clamshell portion being removably mounted on a rear face of the respirator cartridge, encompasses arrangements in which e.g. the front and rear clamshell portions are fastened to each other rather than to the cartridge itself, with the clamshell portions (and the prefilter) being held on place on the cartridge by the pressure of the clamshell portions rather than by any specific fastening mechanism between a clamshell portion and the cartridge. This concept of removable mounting likewise includes arrangements in which the clamshell portions are held in place e.g. by one or more bands that wrap around the outside of both clamshell portions to apply inward pressure to hold them in place on the cartridge.

In some embodiments, a clamshell portion may be removably mounted on a face of a respirator cartridge by being removably attached to the respirator cartridge. In specific embodiments, such attachment may be by way of a snap-fit between the clamshell portion and the cartridge. For example, to aid in the snap-fitting of front clamshell portion 10 to front face 201 of cartridge 200, front clamshell portion 10 may comprise at least a first sidewall 16 (seen e.g. in FIG. 3) that extends along at least a portion of a first major edge 36 of front clamshell portion 10, and a second sidewall 18 that extends along at least a portion of a second, generally oppositely-facing major edge 38 of front clamshell portion 10. First sidewall 16 of front clamshell portion 10 may comprise a first mating feature 17 (also best seen in FIG. 3) that can be snap fitted to a complementary mating feature of a first sidewall 218 of cartridge 200. (Such a complementary mating feature of first sidewall 218 of cartridge 200, although not visible in any Figure, may be similar to mating feature 217 of second sidewall 216 of cartridge 200 as shown in FIG. 2). Likewise, second sidewall 18 of front clamshell portion 10 may comprise a second mating feature (e.g., similar to feature 17, but not visible in any Figure) that can be snap fitted to complementary mating feature 217 of second sidewall 216 of cartridge 200. Such complementary mating features may take the form of e.g. any suitable combination of detent structures, e.g. protrusions, recessions, and so on.

Similar considerations apply to rear clamshell portion 20 being snap-fitted to rear face 202 of cartridge 200. For example, rear clamshell portion 20 may comprise at least a first sidewall 26 (seen e.g. in FIG. 3) that extends along at least a portion of a first major edge 37 of rear clamshell portion 20, and a second sidewall 28 that extends along at least a portion of a second, generally oppositely-facing major edge 39 of rear clamshell portion 20. First sidewall 26 of rear clamshell portion 20 may comprise a first mating feature 27 that can be snap fitted to a complementary, rear mating feature of a first sidewall 218 of cartridge 200. Likewise, second sidewall 28 of rear clamshell portion 20 may comprise a second mating feature that can be snap fitted to a complementary, rear mating feature of second sidewall 216 of cartridge 200.

The rear mating features of cartridge 200 may take any suitable form. In particular embodiments, cartridge 200 (specifically, the housing thereof) may be made by providing a main body 230 with sidewalls 216, 218, and so on, and attaching lid 231 thereto (both of these components are most easily seen in FIG. 2). In designs in which lid 231 has a lip 227 that protrudes slightly proud of the adjacent major surface of a sidewall of the cartridge main body (as in FIG. 2), this lip may be used as a complementary mating feature to which e.g. mating feature 27 of rear clamshell portion 20 can be snap fitted. (If a lid is provided on a front face of cartridge rather than a rear face, similar considerations apply with respect to snap fitting front clamshell portion 10 to the front face of cartridge 200).

The aforementioned sidewalls (e.g. sidewalls 16 and 18 of front clamshell portion 10, and sidewalls 26 and 28 of rear clamshell portion 20), if present, may take any suitable form, and may extend around any portion of the perimeter of front clamshell portion 10 and/or rear clamshell portion 20 as desired. Such sidewalls (whether or not they comprise e.g. any snap fitting mating structures) may conveniently extend at least generally inward so as to help stably hold prefilter cover 1 in place on cartridge 200 when the prefilter cover is in the second, closed position.

Cartridge

Bidirectional-airflow respirator cartridge 200 may be of any suitable design and may comprise any suitable functionality. Often, cartridge 200 (e.g., an interior space thereof, within a housing defined at least partially by main body 230 and lid 231) may contain one or more materials that interact with a gaseous fluid (e.g. an airstream) to at least partially remove one or more components (e.g., gases, vapors, aerosols, and so on) therefrom. The components in the fluid may be e.g. sorbed onto or into an active sorbent, may be reacted with a reactive ingredient, may be exposed to a catalyst, and so on. Thus, in some embodiments cartridge 200 may contain a plurality of bodies (e.g., beads, flakes, granules, particles, or agglomerates) that are sorptive, catalytic, reactive, or combinations thereof.

Potentially suitable materials for such uses include e.g., activated carbon; alumina and other metal oxides; sodium bicarbonate; metal particles (e.g., silver particles) that can remove a component from a fluid by adsorption, chemical reaction, or amalgamation; catalytic agents such as hopcalite and/or gold (which can catalyze the oxidation of carbon monoxide); clay and other minerals treated with acidic solutions such as acetic acid or alkaline solutions such as aqueous sodium hydroxide; ion exchange resins; molecular sieves and other zeolites; silica; biocides; fungicides and virucides. Mixtures of any such materials can be employed. In some embodiments, such materials may be provided in a filter bed. In other embodiments, such materials may be provided as particles in a particle-loaded web. Combinations of any of these approaches may be used. If desired, such materials may be treated e.g. with one or more impregnants to enhance gas removal capability. Examples of treated materials include chemically surface-treated activated carbon. While prefilter 100 may be used to perform at least some filtering of airborne particles, the materials within cartridge 200 may also perform additional filtration of airborne particles (whether in addition to, or instead of, e.g. removing gaseous or vapor components from the airstream).

Figure 6:
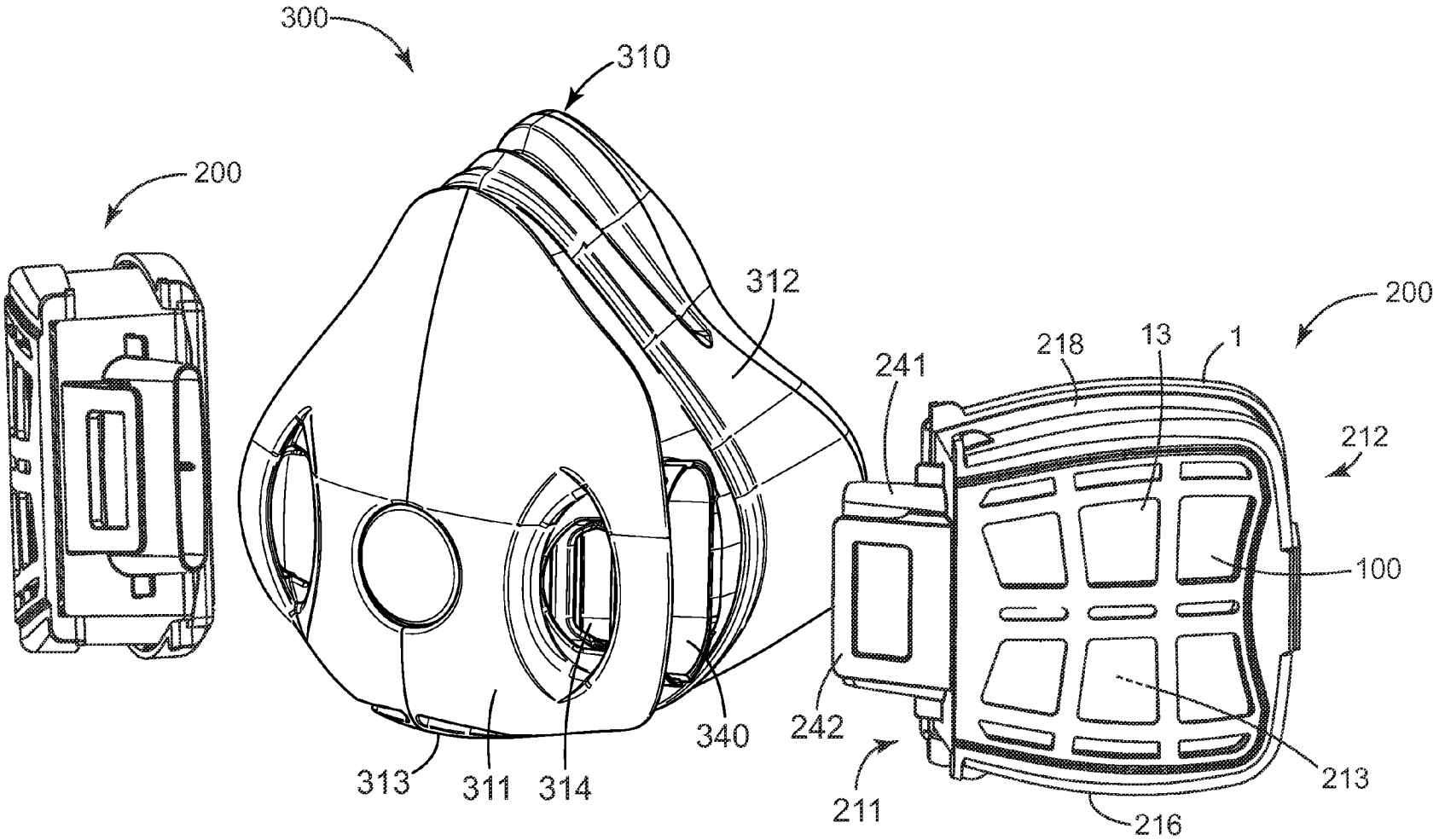
FIG. 6 is a front perspective partially exploded view of an exemplary respirator comprising a bidirectional-airflow respirator cartridge, prefilter, and prefilter cover.

Shown in FIG. 6 in front perspective partially exploded view is an exemplary respirator 300 including a (disengaged) bidirectional-airflow respirator cartridge 200, a prefilter 100, and a prefilter cover 1. In the illustrated embodiment exemplary respirator 300 is a half mask respirator that may be worn by a user to cover the nose and mouth and to define an interior air space. However, a bidirectional-airflow respirator cartridge 200, prefilter 100, and prefilter cover 1 as disclosed herein may be used with any type of respirator, including e.g. a full mask respirator, a powered air respirator, and so on. Exemplary respirator 300 includes a respirator body (e.g., a mask body) 310 and one or more (in the depicted embodiment, two) bidirectional-airflow respirator cartridges 200 located on generally opposed sides of respirator body 310. (Any additional respirator cartridges may comprise prefilters and prefilter covers as described herein.)

In some embodiments, respirator body 310 may include one or more at least semi-rigid portions 311 and a resilient face-contacting portion 312. An exhalation valve 313 may be provided to allow exhaled air to be discharged from an interior air space. Respirator 300 may also include a harness assembly (not shown) that is able to support respirator body 310 on a user's head.

A bidirectional-airflow respirator cartridge may be fluidically coupled with a respirator body in any desired manner. For example, as depicted in FIG. 6, respirator body 310 may include one or more receivers 340 that are each configured to receive a nozzle 241 of a respirator cartridge 200. Cartridge nozzle 241 may cooperate with receiver 340 to provide an airflow channel from respirator cartridge 200 to respirator body 310. Arrangements of this type are described in further detail in U.S. patent application Ser. No. 13/757,434, filed 1 Feb. 2013 and entitled Sleeve-Fit Respirator Cartridge. In some embodiments, a receiver of this general type may include an elastomeric sleeve to e.g. enhance the airtight fitting of a cartridge nozzle thereinto, as described in U.S. patent application Ser. No. 14/081,396, filed 15 Nov. 2013 and entitled Respirator with Floating Elastomeric Sleeve. In some embodiments, a side (specifically, a proximal end) of a bidirectional-airflow cartridge may be mated to a cartridge receptacle, which cartridge receptacle can be mated to a respirator body. Arrangements of this general type are disclosed U.S. Patent Application Publication 2013/0125896 to Dwyer.

All of the above-listed designs fall into a first category in which the proximal end of a bidirectional-airflow respirator cartridge is fluidly connected (whether directly or indirectly) with a respirator body. In a second, alternative category, a bidirectional-airflow respirator cartridge may be configured so that the fluid connection with the respirator body is through the rear major face of the cartridge rather than through the proximal end of the cartridge. Designs of this general type are disclosed in U.S. Pat. No. 8,460,423 to Legare. It is emphasized that the herein-disclosed prefilter cover and prefilter can be used in designs of this second category, e.g. by providing one or more notches, cutouts, and the like, in the rear clamshell portion of the prefilter cover and/or in the rear portion of the prefilter.

It is also noted that while the exemplary embodiments presented herein have used an end-wrap approach in which the flexible connection between front and rear clamshell portions is located at the proximal end of a respirator cartridge, it is also possible to use a side-wrap approach in which the flexible connection between front and rear clamshell portions resides at a lateral side of a respirator cartridge (e.g., resides near either sidewall 216 or 218 of cartridge 200). Similar considerations apply to prefilter 100.

In general, a bidirectional-airflow respirator cartridge 200 may be secured to a respirator body 310 (e.g., in addition to being at least partially held by the mating of any of the above-recited fluidic connections) by one or more latches, snaps, threads, clasps, connectors, or other suitable complementary features known in the art. In an exemplary embodiment illustrated in FIG. 6, cartridge 200 includes a flange 242 that protrudes from proximal end 211 thereof, which flange 242 is reversibly engagable with a complementary mating member 314 of respirator body 310 to form a latch. Protruding flange 242 may thus, when cartridge 200 is e.g. slidably seated against respirator body 310, snap into mating engagement with mating member 314. When it is desired to remove cartridge 200, manual pressure may be exerted on protruding flange 242 and/or mating member 314 (depending on the particular design employed) to disengage these components from each other to allow cartridge 200 to be slidably disengaged from respirator body 310. Many other configurations may be employed, involving e.g. threadable engaging and disengaging of cartridge 200 with respirator body 310, and the like. Cartridge 200 and respirator body 310 may include one or more alignment features, such as protrusions, channels, or other suitable alignment features as known in the art, that cooperate to properly align cartridge 200 and respirator body 310 for mating.

At a desired time, a user of respirator 300 may replace prefilter 100. After any fasteners or latches, if present, have been unlatched, removed, or the like, outward pressure may be applied to the front and rear clamshell portions 10 and 20 to move these portions from their second (closed) position, toward a first (open) position. To facilitate this operation, features (e.g., front pry tabs 31 and rear pry tabs 32) may be provided in prefilter cover 1. In particular embodiments, the opening of prefilter cover 1, and commensurate removing of prefilter cover 1 from cartridge 200, may be performed manually by a user using fingers, without the use of any special tools. (In various embodiments, the removing of prefilter cover 1 may be performed with cartridge 200 engaged with respirator body 310, or with cartridge 200 disengaged from respirator body 310.) Once prefilter cover 1 is removed from cartridge 200, a prefilter 100 therein may be removed and disposed or recycled. At least one fresh prefilter (whether in the form of a single unitary prefilter, or separate, individual front and rear prefilters) may then be appropriately positioned and front and rear clamshell portions 10 and 20 moved toward their second, closed position, e.g. to snap-fit them onto place on cartridge 200. In some embodiments, rear clamshell portion 20 may first be attached to the rear face of cartridge 200, followed by the clamshell portions being moved to the second, closed position and e.g. front clamshell portion 10 being attached to the front face of cartridge 200. (FIG. 1 shows an exemplary attachment method of this type, in which rear clamshell portion 20 has been attached to rear face 202 of cartridge 200, with front clamshell portion 10 not yet having been attached to front face 201 of the cartridge.) Or, the reverse order can be followed. Furthermore, the moving of front and rear clamshell portions relative to each other encompasses all variations such as moving both portions, moving the front portion while the rear portion remains stationary, and moving the rear portion while the front portion remains stationary. To facilitate the uses disclosed herein, a kit (e.g., a refill kit) may be provided that includes a plurality of prefilters, e.g. along with at least one prefilter cover if desired.

LIST OF EXEMPLARY EMBODIMENTS

Embodiment 1 is a prefilter cover for a bidirectional-airflow respirator cartridge, the prefilter cover comprising: a front clamshell portion with a proximal end and a distal end and an air-permeable major area, a rear clamshell portion with a proximal end and a distal end and an air-permeable major area, and at least one flexible connecting member that flexibly connects the front clamshell portion and the rear clamshell portion, wherein the front clamshell portion is adapted to be removably mounted on a front face of a bidirectional-airflow respirator cartridge and the rear clamshell portion is adapted to be removably mounted on a rear face of the bidirectional-airflow respirator cartridge. Embodiment 2 is the prefilter cover of embodiment 1 wherein the least one flexible connecting member flexibly connects the distal end of the front clamshell portion and the distal end of the rear clamshell portion.

Embodiment 3 is the prefilter cover of any of embodiments 1-2 wherein the prefilter cover is adapted so that: when the front clamshell portion is removably mounted on a front face of a bidirectional-airflow respirator cartridge, the front clamshell portion holds a front prefilter between the air-permeable major area of the front clamshell portion of the prefilter cover and an air-permeable major area of the front face of the cartridge, so that the front prefilter is in occlusive, filtering relation to the air-permeable major area of the front face of the cartridge; and, when the rear clamshell portion is removably mounted on a rear face of the bidirectional-airflow respirator cartridge, the rear clamshell portion holds a rear prefilter between the air-permeable major area of the rear clamshell portion of the prefilter cover and an air-permeable major area of the rear face of the cartridge, so that the rear prefilter is in occlusive, filtering relation to an air-permeable major area of the rear face of the cartridge.

Embodiment 4 is the prefilter cover of any of embodiments 1-3, wherein the front and rear clamshell portions are movable relative to each other between a first position in which the air-permeable major area of the front clamshell portion and the air-permeable major area of the rear clamshell portion are oriented at a first-position angle to each other of at least about 45 degrees, and a second position in which the air-permeable major area of the front clamshell portion and the air-permeable major area of the rear clamshell portion are oriented at a second-position angle to each other of at most about 35 degrees and are in at least generally overlapping relation to each other, and, wherein the at least one flexible connecting member provides an offset connection such that, when the front and rear clamshell portions are in the second position, an inside surface of the air-permeable major area of the front clamshell portion and an inside surface of the air-permeable major area of the rear clamshell portion are positioned at an offset distance from each other that is, on average, at least about 1 cm. Embodiment 5 is the prefilter cover of embodiment 4 wherein the first-position angle is at least about 90 degrees and the second-position angle is at most about 20 degrees and the offset distance is at least about 2 cm.

Embodiment 6 is the prefilter cover of any of embodiments 1-5 wherein the front clamshell portion, the rear clamshell portion, and the at least one flexible connecting member are all integral portions of a single integral injection-molded piece. Embodiment 7 is the prefilter cover of any of embodiments 1-6 wherein the at least one flexible connecting member has a length and comprises a first living hinge proximate the front clamshell portion and a second living hinge proximate the rear clamshell portion, and wherein the first and second living hinges are separated from each other, along the length of the flexible connecting member, by at least about 1 cm. Embodiment 8 is the prefilter cover of embodiment 7 wherein each living hinge is provided by a locally thinned area that extends across a width of the flexible connecting member, which locally thinned area exhibits a thickness that is less than about 30% of a thickness of at least one area of the flexible connecting member that adjacently neighbors the locally thinned area along the length direction of the flexible connecting member. Embodiment 9 is the prefilter cover of any of embodiments 1-8 wherein the at least one flexible connecting member is comprised of an inherently flexible material.

Embodiment 10 is a bidirectional-airflow respirator cartridge with at least one prefilter mounted thereon and with a prefilter cover removably attached thereto, comprising: a bidirectional-airflow respirator cartridge comprising a main body with a proximal end and a distal end, and a front face with a major air-permeable area thereof and a rear face with a major air-permeable area thereof; a prefilter cover comprising a front clamshell portion with a proximal end and a distal end and an air-permeable major area, a rear clamshell portion with a proximal end and a distal end and an air-permeable major area, and at least one flexible connecting member that flexibly connects the front clamshell portion and the rear clamshell portion, and, a front prefilter and a rear prefilter, wherein the front clamshell portion of the prefilter cover is removably mounted on the front face of the bidirectional-airflow respirator cartridge and holds the front prefilter between the air-permeable major area of the front clamshell portion of the prefilter cover and the air-permeable major area of the front face of the cartridge, so that the front prefilter is in occlusive, filtering relation to the air-permeable major area of the front face of the cartridge, and wherein the rear clamshell portion of the prefilter cover is removably mounted on the rear face of the bidirectional-airflow respirator cartridge and holds the rear prefilter between the air-permeable major area of the rear clamshell portion of the prefilter cover and the air-permeable major area of the rear face of the cartridge, so that the rear prefilter is in occlusive, filtering relation to the air-permeable major area of the rear face of the cartridge.

Embodiment 11 is the bidirectional-airflow respirator cartridge of embodiment 10 wherein the front clamshell portion of the prefilter cover holds the front prefilter in contact with an inside surface of the air-permeable major area of the front clamshell portion of the prefilter cover and with an outside surface of the air-permeable major area of the front face of the cartridge, and wherein the rear clamshell portion of the prefilter cover holds the rear prefilter in contact with an inside surface of the air-permeable major area of the rear clamshell portion of the prefilter cover and with an outside surface of the air-permeable major area of the rear face of the cartridge.

Embodiment 12 is the bidirectional-airflow respirator cartridge of any of embodiments 10-11 wherein the front prefilter and the rear prefilter are flexibly connected by a prefilter connecting portion that extends between the front prefilter and the rear prefilter. Embodiment 13 is the bidirectional-airflow respirator cartridge of embodiment 12 wherein the front prefilter and the rear prefilter and the prefilter connecting portion are portions of a single unitary prefilter, and wherein the prefilter connecting portion integrally extends between the front prefilter portion and the rear prefilter portion. Embodiment 14 is the bidirectional-airflow respirator cartridge of embodiment 13 wherein the front prefilter portion and the rear prefilter portion are sized and shaped at least generally similarly to each other so that so that the single unitary prefilter is front-rear reversible. Embodiment 15 is the bidirectional-airflow respirator cartridge of any of embodiments 13-14 wherein the single unitary prefilter is a multilayer prefilter comprised of multiple layers of fibrous filter material. Embodiment 16 is the bidirectional-airflow respirator cartridge of embodiment 15 wherein the single unitary prefilter comprises an outside surface and an inside surface and wherein at least one of the outside surface and the inside surface exhibit an indicia identifying a preferred outside-inside orientation of the multilayer prefilter.

Embodiment 17 is the bidirectional-airflow respirator cartridge of any of embodiments 10-16 wherein the front clamshell portion is removably snap-fitted to the front face of the bidirectional-airflow respirator cartridge and the rear clamshell portion is removably snap-fitted to the rear face of the bidirectional-airflow respirator cartridge. Embodiment 18 is the bidirectional-airflow respirator cartridge of embodiment 17 wherein the front clamshell portion comprises at least a first sidewall that extends along at least a portion of a first major edge of the front clamshell portion, and a second sidewall that extends along at least a portion of a second, generally oppositely-facing major edge of the front clamshell portion; and, wherein the first sidewall of the front clamshell portion comprises a first mating feature that is snap fitted to a complementary mating feature of a first sidewall of the cartridge, and wherein the second sidewall of the front clamshell portion comprises a second mating feature snap that is snap fitted to a complementary mating feature of a second sidewall of the cartridge, which second sidewall of the cartridge generally opposes the first sidewall of the cartridge. Embodiment 19 is the bidirectional-airflow respirator cartridge of any of embodiments 10-18 wherein the front clamshell portion comprises at least one front compressing structure that at least partially bounds the air-permeable major area of the front clamshell portion, and that presses a portion of the front prefilter against a receiving structure of the front face of the cartridge, which receiving structure at partially bounds the air-permeable major area of the front face of the cartridge.

Embodiment 20 is a respirator comprising a respirator body with the bidirectional-airflow respirator cartridge of any of embodiments 10-19 fluidly connected thereto. Embodiment 21 is the respirator of embodiment 20 wherein the cartridge is fluidly connected to the respirator body by way of a connection that is located at the proximal end of the cartridge. Embodiment 22 is the respirator of any of embodiments 20-21 wherein the bidirectional-airflow respirator cartridge is a first cartridge that is fluidly connected to the respirator body, and wherein the respirator further comprises a second bidirectional-airflow respirator cartridge that is fluidly connected to the same respirator body. Embodiment 23 is the respirator of any of embodiments 20-22 wherein the respirator is a half-mask respirator, a full-mask respirator, or a powered-air respirator.

Embodiment 24 is a kit comprising: at least one prefilter cover of any of embodiments 1-9; and, a plurality of prefilters, each prefilter comprising a front prefilter portion and a rear prefilter portion flexibly connected by a prefilter connecting portion. Embodiment 25 is the kit of embodiment 24, wherein for each prefilter of the plurality of prefilters, the front prefilter portion and the rear prefilter portion and the prefilter connecting portion are portions of a single unitary prefilter, and wherein the prefilter connecting portion integrally extends between the front prefilter portion and the rear prefilter portion.

It will be apparent to those skilled in the art that the specific exemplary elements, structures, features, details, configurations, etc., that are disclosed herein can be modified and/or combined in numerous embodiments. All such variations and combinations are contemplated by the inventor as being within the bounds of the conceived invention, not merely those representative designs that were chosen to serve as exemplary illustrations. Thus, the scope of the present invention should not be limited to the specific illustrative structures described herein, but rather extends at least to the structures described by the language of the claims, and the equivalents of those structures. Any of the elements that are positively recited in this specification as alternatives may be explicitly included in the claims or excluded from the claims, in any combination as desired. Any of the elements or combinations of elements that are recited in this specification in open-ended language (e.g., comprise and derivatives thereof), are considered to additionally be recited in closed-ended language (e.g., consist and derivatives thereof) and in partially closed-ended language (e.g., consist essentially, and derivatives thereof). To the extent that there is any conflict or discrepancy between this specification as written and the disclosure in any document incorporated by reference herein, this specification as written will control.

What is claimed is:

1. A prefilter cover for a bidirectional-airflow respirator cartridge, the prefilter cover comprising a front clamshell portion with a proximal end and a distal end and an air-permeable major area, a rear clamshell portion with a proximal end and a distal end and an air-permeable major area, and, at least one flexible connecting member that flexibly connects the distal end of the front clamshell portion and the distal end of the rear clamshell portion, wherein the front clamshell portion is adapted to be removably mounted on a front face of a bidirectional-airflow respirator cartridge and the rear clamshell portion is adapted to be removably mounted on a rear face of the bidirectional-airflow respirator cartridge.

2. The prefilter cover of claim 1 wherein the prefilter cover is adapted so that:

when the front clamshell portion is removably mounted on a front face of a bidirectional-airflow respirator cartridge, the front clamshell portion holds a front prefilter between the air-permeable major area of the front clamshell portion of the prefilter cover and an air-permeable major area of the front face of the cartridge, so that the front prefilter is in occlusive, filtering relation to the air-permeable major area of the front face of the cartridge; and, when the rear clamshell portion is removably mounted on a rear face of the bidirectional-airflow respirator cartridge, the rear clamshell portion holds a rear prefilter between the air-permeable major area of the rear clamshell portion of the prefilter cover and an air-permeable major area of the rear face of the cartridge, so that the rear prefilter is in occlusive, filtering relation to an air-permeable major area of the rear face of the cartridge.

3. The prefilter cover of claim 1, wherein the front and rear clamshell portions are movable relative to each other between a first position in which the air-permeable major area of the front clamshell portion and the air-permeable major area of the rear clamshell portion are oriented at a first-position angle to each other of at least about 45 degrees, and a second position in which the air-permeable major area of the front clamshell portion and the air-permeable major area of the rear clamshell portion are oriented at a second-position angle to each other of at most about 35 degrees and are in at least generally overlapping relation to each other, and, wherein the at least one flexible connecting member provides an offset connection such that, when the front and rear clamshell portions are in the second position, an inside surface of the air-permeable major area of the front clamshell portion and an inside surface of the air-permeable major area of the rear clamshell portion are positioned at an offset distance from each other that is, on average, at least about 1 cm.

4. The prefilter cover of claim 1 wherein the front clamshell portion, the rear clamshell portion, and the at least one flexible connecting member are all integral portions of a single integral injection-molded piece.

5. The prefilter cover of claim 4 wherein the at least one flexible connecting member has a length and comprises a first living hinge proximate the front clamshell portion and a second living hinge proximate the rear clamshell portion, and wherein the first and second living hinges are separated from each other, along the length of the flexible connecting member, by at least about 1 cm.

6. The prefilter cover of claim 5 wherein each living hinge is provided by a locally thinned area that extends across a width of the flexible connecting member, which locally thinned area exhibits a thickness that is less than about 30% of a thickness of at least one area of the flexible connecting member that adjacently neighbors the locally thinned area along the length direction of the flexible connecting member.

7. The prefilter cover of claim 1 wherein the at least one flexible connecting member is comprised of an inherently flexible material.

8. A bidirectional-airflow respirator cartridge with at least one prefilter mounted thereon and with a prefilter cover removably attached thereto, comprising:

a bidirectional-airflow respirator cartridge comprising, a main body with a proximal end and a distal end, and a front face with a major air-permeable area thereof and a rear face with a major air-permeable area thereof, a prefilter cover comprising, a front clamshell portion with a proximal end and a distal end and an air-permeable major area, a rear clamshell portion with a proximal end and a distal end and an air-permeable major area, and at least one flexible connecting member that flexibly connects the distal end of the front clamshell portion and the distal end of the rear clamshell portion, and, a front prefilter and a rear prefilter, wherein the front clamshell portion of the prefilter cover is removably mounted on the front face of the bidirectional-airflow respirator cartridge and holds the front prefilter between the air-permeable major area of the front clamshell portion of the prefilter cover and the air-permeable major area of the front face of the cartridge, so that the front prefilter is in occlusive, filtering relation to the air-permeable major area of the front face of the cartridge, and wherein the rear clamshell portion of the prefilter cover is removably mounted on the rear face of the bidirectional-airflow respirator cartridge and holds the rear prefilter between the air-permeable major area of the rear clamshell portion of the prefilter cover and the air-permeable major area of the rear face of the cartridge, so that the rear prefilter is in occlusive, filtering relation to the air-permeable major area of the rear face of the cartridge.

9. The bidirectional-airflow respirator cartridge of claim 8 wherein the front clamshell portion of the prefilter cover holds the front prefilter in contact with an inside surface of the air-permeable major area of the front clamshell portion of the prefilter cover and with an outside surface of the air-permeable major area of the front face of the cartridge, and wherein the rear clamshell portion of the prefilter cover holds the rear prefilter in contact with an inside surface of the air-permeable major area of the rear clamshell portion of the prefilter cover and with an outside surface of the air-permeable major area of the rear face of the cartridge.

10. The bidirectional-airflow respirator cartridge of claim 8 wherein the front prefilter and the rear prefilter are flexibly connected by a prefilter connecting portion that extends between a distal end of the front prefilter and a distal end of the rear prefilter.

11. The bidirectional-airflow respirator cartridge of claim 10 wherein the front prefilter and the rear prefilter and the prefilter connecting portion are portions of a single unitary prefilter, and wherein the prefilter connecting portion integrally extends between the distal end of the front prefilter portion and the distal end of the rear prefilter portion.

12. The bidirectional-airflow respirator cartridge of claim 11 wherein the front prefilter portion and the rear prefilter portion are sized and shaped at least generally similarly to each other so that so that the single unitary prefilter is front-rear reversible.

13. The bidirectional-airflow respirator cartridge of claim 11 wherein the single unitary prefilter is a multilayer prefilter comprised of multiple layers of fibrous filter material.

14. The bidirectional-airflow respirator cartridge of claim 13 wherein the single unitary prefilter comprises an outside surface and an inside surface and wherein at least one of the outside surface and the inside surface exhibit an indicia identifying a preferred outside-inside orientation of the multilayer prefilter.

15. The bidirectional-airflow respirator cartridge of claim 8 wherein the front clamshell portion is removably snap-fitted to the front face of the bidirectional-airflow respirator cartridge and the rear clamshell portion is removably snap-fitted to the rear face of the bidirectional-airflow respirator cartridge.

16. The bidirectional-airflow respirator cartridge of claim 15 wherein the front clamshell portion comprises at least a first sidewall that extends along at least a portion of a first major edge of the front clamshell portion, and a second sidewall that extends along at least a portion of a second, generally oppositely-facing major edge of the front clamshell portion; and, wherein the first sidewall of the front clamshell portion comprises a first mating feature that is snap fitted to a complementary mating feature of a first sidewall of the cartridge, and wherein the second sidewall of the front clamshell portion comprises a second mating feature snap that is snap fitted to a complementary mating feature of a second sidewall of the cartridge, which second sidewall of the cartridge generally opposes the first sidewall of the cartridge.

17. The bidirectional-airflow respirator cartridge of claim 8 wherein the front clamshell portion comprises at least one front compressing structure that at least partially bounds the air-permeable major area of the front clamshell portion, and that presses a portion of the front prefilter against a receiving structure of the front face of the cartridge, which receiving structure at least partially bounds the air-permeable major area of the front face of the cartridge.

18. A respirator comprising a respirator body with the bidirectional-airflow respirator cartridge of claim 8 fluidly connected thereto.

19. The respirator of claim 18 wherein the cartridge is fluidly connected to the respirator body by way of a connection that is located at the proximal end of the cartridge.

20. The respirator of claim 18 wherein the bidirectional-airflow respirator cartridge is a first cartridge that is fluidly connected to the respirator body, and wherein the respirator further comprises a second bidirectional-airflow respirator cartridge that is fluidly connected to the same respirator body.

21. The respirator of claim 18 wherein the respirator is a half-mask respirator, a full-mask respirator, or a powered-air respirator.

22. A kit comprising:

at least one prefilter cover of claim 1; and, a plurality of prefilters, each prefilter comprising a front prefilter portion and a rear prefilter portion flexibly connected by a prefilter connecting portion.

23. The kit of claim 22, wherein for each prefilter of the plurality of prefilters, the front prefilter portion and the rear prefilter portion and the prefilter connecting portion are portions of a single unitary prefilter, and wherein the prefilter connecting portion integrally extends between the distal end of the front prefilter portion and the distal end of the rear prefilter portion.

* * * * *